United States Patent [19]

Melucci

[11] Patent Number: 4,784,291

[45] Date of Patent: Nov. 15, 1988

[54] DISPENSER FOR SMALL UNIFORMLY SHAPED ARTICLES

[75] Inventor: Donald W. Melucci, Lincoln, R.I.

[73] Assignee: Pharmtech Corporation, Warwick, R.I.

[21] Appl. No.: 67,139

[22] Filed: Jun. 26, 1987

[51] Int. Cl.[4] ..... B65D 83/04

[52] U.S. Cl. ..... 221/187; 221/190; 221/196; 221/238; 221/246; 221/254

[58] Field of Search ..... 221/196, 190, 187, 195, 221/238, 246, 254, 264

[56] References Cited

U.S. PATENT DOCUMENTS 2,566,808 9/1951 Petty ..... 221/190 X

FOREIGN PATENT DOCUMENTS

| | | | |
|---|---|---|---|
| 1094447 | 5/1955 | France | 221/196 |
| 71228 | 2/1970 | German Democratic Rep. | 221/154 |
| a336551 | 2/1936 | Italy | 221/190 |
| 354980 | 8/1931 | United Kingdom | 221/190 |

*Primary Examiner*—Charles A. Marmor

*Attorney, Agent, or Firm*—Salter & Michaelson

[57] ABSTRACT

A dispenser for articles such as pills or capsules is operative with a reciprocating motion for dispensing individual articles. The dispenser includes a base portion and a slide member on the base portion which is reciprocally movable with respect to the base portion between a lower first position and an upper second position for dispensing articles in succession.

11 Claims, 3 Drawing Sheets

DISPENSER FOR SMALL UNIFORMLY SHAPED ARTICLES

BACKGROUND AND SUMMARY OF THE INVENTION

The instant invention relates to dispensing apparatus and more particularly to a dispenser for small articles of substantially uniform dimension and configuration, such as pills, capsules, lozenges, or small candies.

The benefits of utilizing dispensers for individually dispensing small articles, such as pills, capsules, or candies, have generally been heretofore recognized. Specifically, it has been recognized that dispensers which are capable of individually dispensing small articles generally eliminate unnecessary handling and contamination of undispensed articles. It has also been recognized that dispensers simplify the procedures which are necessary for obtaining individual articles from containers, and that they reduce the risks of inadvertent overdosages.

However, while the benefits of utilizing dispensers for dispensing small articles have heretofore been recognized, the prior art has generally failed to provide an effective device for reliably individually dispensing articles, such as pills or capsules, in succession. In this regard, the Apfelbaum U.S. Pat. Nos. 2,352,066; 2,353,629; 2,377,120; Kantrow U.S. Pat. No. 3,027,000; Meijer U.S. Pat. No. 3,095,085; Espinal U.S. Pat. No. 3,477,561; Robbins U.S. Pat. No. 3,678,884; Infante-Diaz et al U.S. Pat. No. 3,863,804; Lorca U.S. Pat. No. 4,154,365; and Tyson U.S. Pat. No. 4,234,093 disclose dispensing devices which are adapted for use in dispensing small articles, such as pills and the like, and represent the closest prior art to the instant invention of which the applicant is aware. However, many of the devices disclosed in these references are incapable of reliably dispensing individual articles in succession. In any event, the above references fail to teach a dispenser which is operative in the manner of the dispenser of the instant invention for reliably dispensing articles in succession, and hence they are believed to be of only general interest with respect to the instant invention.

The instant invention provides a novel and effective dispenser which is operative with a reciprocating action for reliably dispensing small ingestible articles, such as pills, capsules, caplets, lozenges or small candies. Specifically, the dispenser of the instant invention comprises a base portion which is receivable on a supporting surface for supporting the dispenser thereon, a slide member mounted on the base portion so that it is upwardly and downwardly slidable with respect thereto between a lower first position and an upper second position when the base portion is received on a supporting surface. The slide member is formed with an enlarged storage chamber therein for containing a plurality of the articles, an intermediate passage communicating with the storage chamber and adapted for receiving articles therefrom, and an outlet passage communicating with the intermediate passage. The outlet passage has an outlet opening therein adjacent the lower end thereof, and it is dimensioned and configured for receiving articles and for passing them outwardly through the outlet opening when the base portion is positioned on a supporting surface. The dispenser further comprises guide means mounted on the base portion which is operable for guiding articles from the storage chamber into the intermediate passage when the slide member is moved from the first position thereof to the second position thereof and then back to the first position thereof and transfer means mounted on the base portion which is operative for obstructing the passage of articles from the intermediate passage to the outlet passage when the slide member is in the first position thereof and for transferring a single article from the intermediate passage to the outlet passage when the slide member is moved from the first position thereof to the second position thereof and then back to the first position thereof. The guide means is preferably operative in the storage chamber, and it defines a rounded, downwardly extending trackway which terminates adjacent the intermediate passage when the slide member is in the first position thereof, and the storage chamber is preferably dimensioned and configured for guiding one of the articles into the trackway when the slide member is in the second position thereof. The intermediate chamber is preferably dimensioned and configured for receiving and containing a single one of the articles at a time, and the guide means is preferably operable for guiding a single article from the storage chamber into the intermediate passage each time the slide member is moved from the first position thereof to the second position thereof and back to the first position thereof. The slide member is preferably further formed with a substantially vertical transfer passage therein, and the intermediate passage is preferably formed so that it extends angularly downwardly from the storage chamber to the transfer passage and communicates with the outlet passage through the transfer passage. The transfer means preferably comprises a transfer pin which travels in the transfer passage when the slide member is moved between the first and second positions thereof. Further, the device is preferably constructed so that the transfer pin obstructs the adjacent end of the intermediate passage when the slide member is in the first position thereof but not when the slide member is in the second position thereof, and the transfer passage is preferably dimensioned and oriented for receiving a single article from the intermediate passage when the slide member is in the second position thereof. Still further, the transfer pin is preferably operative for engaging an article received in the transfer passage and for transferring it to the outlet passage as the slide member is moved from the second position thereof to the first position thereof. The transfer pin preferably extends substantially perpendicularly upwardly from the base portion, and the slide member is preferably reciprocally movable in a substantially vertical direction when the base portion is received on a supporting surface. The device preferably further comprises an outer sleeve which extends upwardly from the base portion, and the slide member preferably travels in the outer sleeve as it is moved from the first position thereof to the second position thereof. Still further, the dispenser preferably comprises an outer cap portion which is secured to the upper end of the slide member so that it travels along the outer side of the outer sleeve when the slide member is moved between the first and second positions thereof and which encloses the outer sleeve when the slide member is in the first position thereof.

For use and operation of the dispenser of the instant invention, a plurality of articles, such as capsules, are placed in the storage chamber by a manufacturer, distributor or vendor of the articles, and the slide member and the cap portion are permanently assembled with the base portion so that the slide member is upwardly and downwardly reciprocally movable between the first and second positions thereof when the base portion is positioned on a supporting surface to maintain the dispenser in a substantially vertical disposition. Thereafter, when the slide member is initially moved from the first position thereof to the second position thereof, a capsule falls into the trackway of the guide means; and when the slide member is then returned to the first position thereof, the capsule is guided into the intermediate passage by the guide means. As long as the slide member is thereafter maintained in the first position thereof, the transfer pin obstructs the intermediate passage so that the capsule is retained in the intermediate passage. However, when the slide member is again moved to the second position thereof, the capsule falls into the transfer passage so that it rests on the upper end of the transfer pin; and when the slide member is again returned to the first position thereof, the capsule is moved upwardly through the transfer passage and into the outlet passage so that it gravitates downwardly and passes through the outlet opening adjacent the lower end of the dispenser.

Accordingly, it is seen that the dispenser of the instant invention is operative with a reciprocating motion for reliably dispensing individual capsules in succession. In this regard, because of the manner in which articles are transferred from the storage chamber to the intermediate passage, from the intermediate passage to the transfer passage and from the transfer passage to the outlet passage, the dispenser is operative for reliably moving individual articles in succession between the storage chamber and the outlet passage as the slide member is reciprocated between the first and second positions thereof. Further, after the slide member has been initially reciprocated, a capsule is dispensed from the device each time the slide member is moved from the first position thereof to the second position thereof and back to the first position thereof.

Accordingly, it is a primary object of the instant invention to provide an effective dispenser for dispensing individual articles in succession.

Another object of the instant invention is to provide an effective device for reliably dispensing ingestible articles, such as capsules, pills, caplets, or small candies.

An even further object of the instant invention is to provide a device for reliably dispensing small articles which is operative with a reciprocating motion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
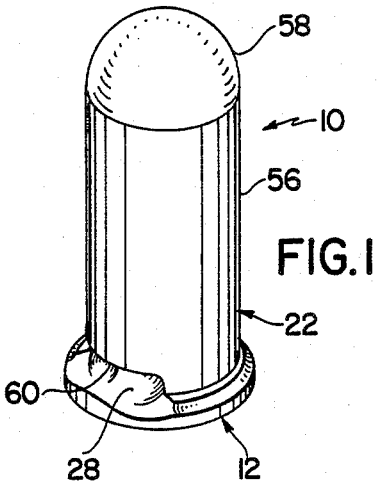
FIG. 1 is a perspective view of the dispenser of the instant invention with the slide member in the first position thereof.
Figure 2:
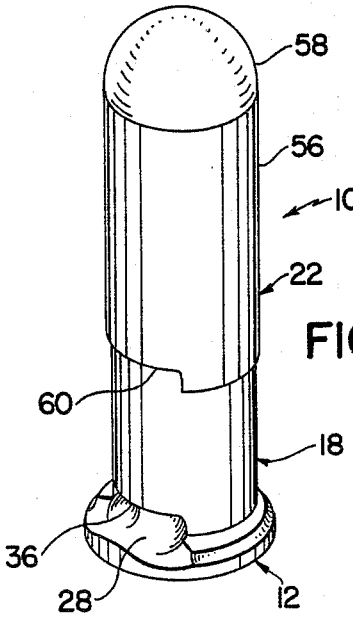
FIG. 2 is a perspective view of the dispenser with the slide member in the second position thereof.
Figure 3:
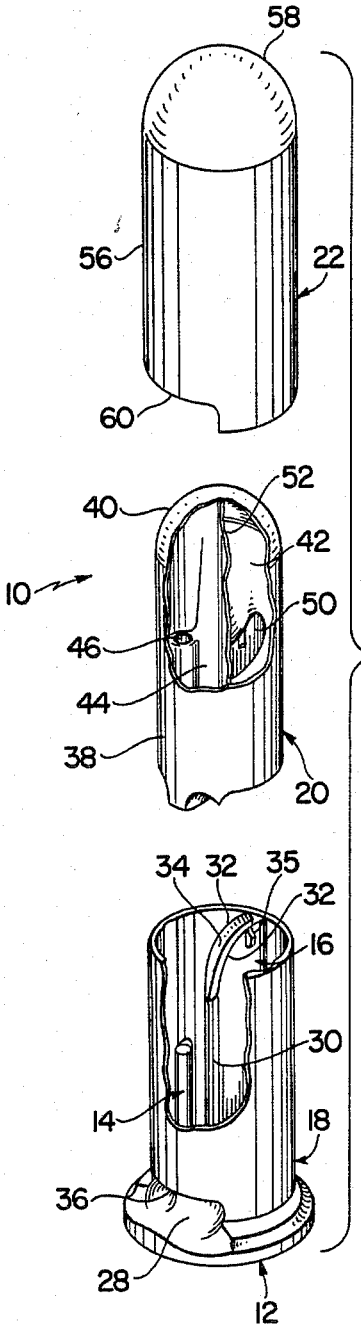
FIG. 3 is a fragmentary exploded perspective view of the dispenser.

Referring now to the drawings, the dispenser of the instant invention is generally indicated at 10 in FIGS. 1 through 9. The dispenser 10 comprises a base portion generally indicated at 12, a transfer pin generally indicated at 14 which extends upwardly from the base portion 12, a guide member generally indicated at 16 which also extends upwardly from the base portion 12, and a sleeve generally indicated at 18 which extends upwardly from the base portion 12 around the transfer pin 14 and the guide member 16. The dispenser 10 further comprises a slide member generally indicated at 20 which travels in the sleeve 18 and an outer cap generally indicated at 22 which is secured to the slide member 20 so that it is positioned around the exterior of the sleeve 18 and travels with the slide member 20. The dispenser 10 as herein embodied is operative for dispensing capsules, such as the capsule 24 illustrated in FIGS. 4 through 9, by reciprocally moving the cap 22 and the slide member 20 upwardly and downwardly with respect to the base portion 12, as will hereinafter be more fully set forth. In this connection, however, it will be understood that other embodiments of the dispenser of the instant invention which are adapted for dispensing other articles, such as pills, caplets, lozenges or small candies, are contemplated.

The base portion 12, the transfer pin 14, the guide member 16 and the sleeve 18 are preferably integrally molded from a suitable plastic material, such as a polystyrene or polyethylene plastic. The base portion 12 is preferably of substantially circular configuration, and it has a substantially flat bottom surface 26 so that it is adapted to be received on a substantially flat supporting surface for supporting the dispenser 10 in a substantially vertical disposition thereon. The base portion 12 is formed with a rounded recess 28 therein adjacent one peripheral edge thereof which is dimensioned for receiving a capsule 24 therein. The transfer pin 14 is of substantially cylindrical configuration, and it extends a distance substantially perpendicularly upwardly from the base portion 12 adjacent the inner portion of the recess 28. The guide member 16 comprises an elongated, substantially flat member which also extends substantially perpendicularly upwardly from the base portion 12. The guide member 16 is formed with a substantially straight vertical inner edge 30, and the upper portion of the guide member 16 is defined by a pair of closely spaced leaves 32 having inwardly angled peripheral edges 34 which cooperate to define a trackway along the upper extremity of the guide member 16. In this regard, the upper extremities of the leaves 32 are formed so that they extend arcuately inwardly and downwardly toward the center of the dispenser 10 as illustrated. The leaves 32 are normally positioned in closely spaced, substantially parallel relation, although they are resiliently movable together for assembling the slide member 20 with the guide member 16 and the transfer pin 14, as will hereinafter be more fully set forth. A pair of locking teeth 35 are provided on the outwardly facing surfaces of the leaves 32 for retaining the slide member 20 in assembled relation with the guide member 16, as will also hereinafter be more fully set forth. The sleeve 18 is of substantially tubular configuration, and it is integrally attached to the base portion 12 so that it also extends substantially perpendicularly upwardly therefrom. The sleeve 18 extends upwardly in slightly outwardly spaced relation to both the guide member 16 and the transfer pin 14, and an opening 36 is provided in the sleeve 18 adjacent the recess 28 for passing capsules 24 outwardly from the interior of the dispenser 10.

Figure 4:
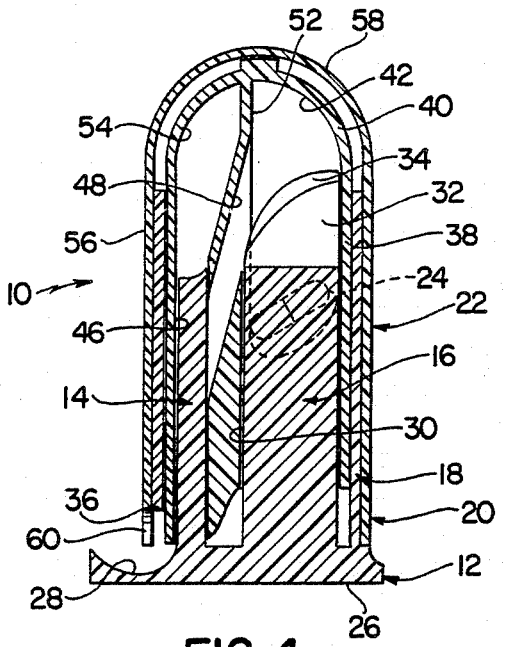
FIGS. 4 through 9 are sectional views illustrating the sequential operation of the dispenser.
Figure 5:
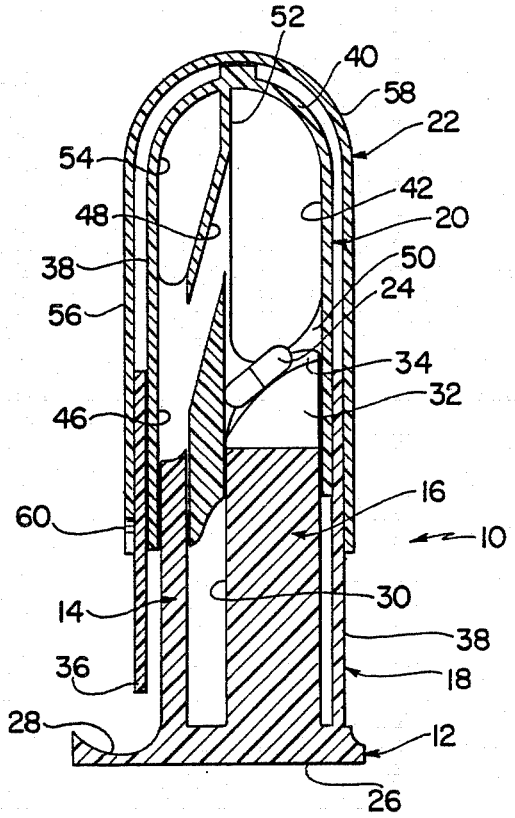
Figure 6:
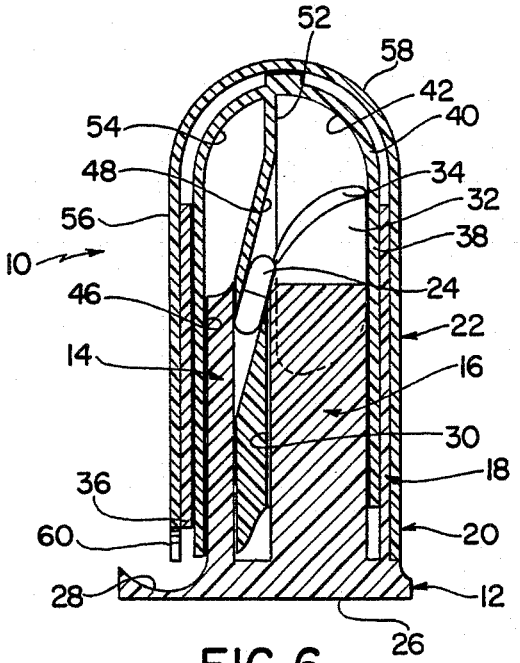
Figure 7:
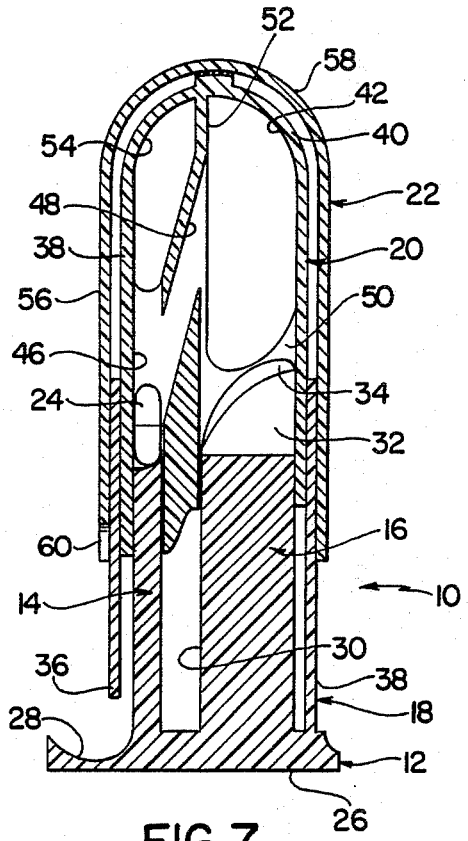
Figure 9:
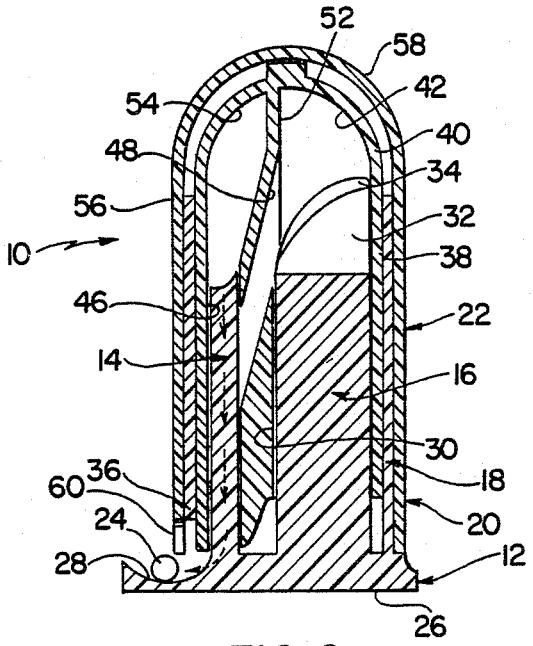

The slide member 20 is also preferably integrally molded from a suitable plastic material, and it is mounted in the sleeve 18 so that it is slidable therein between the lower first position illustrated in FIGS. 4, 6 and 9 and the upper second position illustrated in FIGS. 5 and 7. The slide member 20 comprises a tubular outer shell 38 which is dimensioned to travel in the sleeve 18 and a rounded upper cap 40 which encloses the upper end of the shell 38. The slide member 20 is formed with a series of internal chambers and passages which are adapted for containing and guiding the capsules 24 as they are dispensed from the device 10. More specifically, the slide member 20 is formed with an enlarged interior storage chamber 42, an outlet passage 44 (illustrated in FIG. 3), a transfer passage 46, and an intermediate passage 48 therein. The storage chamber 42 is dimensioned for receiving and containing a plurality of the capsules 24 therein, and a slot 50 extends downwardly through the lower end of the storage chamber 42 and is dimensioned for slidably receiving the guide member 16 therethrough. Further, the lower portion of the storage chamber 42 is preferably formed in a rounded funnel-like configuration so that capsules 24 contained in the storage chamber 42 normally gravitate toward the central bottom portion of the chamber 42. A central interior wall 52 separates the storage chamber 52 from the outlet passage 44, and the transfer passage 48 which is of tubular configuration passes through the wall 52 so that it extends angularly downwardly from a point adjacent the inner edge of the slot 50. The transfer slot 48 is preferably dimensioned for receiving and containing a single capsule 24 therein so that the capsule 24 is positioned in the manner illustrated in FIG. 6. The transfer passage 46 is of tubular configuration, and it extends in substantially parallel relation to the longitudinal extent of the slide member 20. In this connection, the transfer passage 46 is dimensioned for slidably receiving the transfer pin 14 therein when the slide member 20 is received on the base portion 12. The transfer passage 46 communicates with the lower end of the intermediate passage 48 for receiving capsules 24 therefrom, and the upper end of the transfer passage 46 opens into the outlet passage 44. A void area 54 is provided in the slide member 20 above the transfer passage 46 and the outlet passage 44. The outlet passage 44 is actually defined by two separate passages which are disposed on opposite sides of the transfer passage 46 and extend downwardly so that they open outwardly through the bottom end of the slide member 20.

The cap member 22 is also preferably integrally molded from a suitable plastic material, and it comprises a tubular wall portion 56 and a rounded upper end portion 58. The interior of the rounded end portion 58 is secured to the exterior of the rounded end portion 40 of the slide member 20 with a suitable adhesive or the like to permanently attach the cap portion 22 to the slide member 20. A notch 60 is formed in the lower portion of the wall portion 56 and aligned with the opening 36 to enable capsules 24 to freely pass through the opening 36 into the recess 28.

In assembled relation, the slide member 20 is received on the base portion 26 so that the transfer pin 14 travels in the transfer passage 46 and so that the guide member 16 travels in the slot 50. In this regard, in order to assemble the slide member 20 with the assembly comprising the base portion 12, the transfer pin 14, the guide member 16 and the sleeve 18, the leaves 32 are resiliently compressed together to provide clearance for the teeth 35 as they pass through the slot 50. However, once the teeth 35 have passed through the upper end of the slot 50, the leaves 32 can return to their normally spaced positions so that the teeth 35 are engageable with the wall of the storage chamber 42 adjacent the slot 50 to prevent the slide member 20 from being removed from the guide member 16. Once the slide member 20 has been assembled on the base portion 12, the transfer pin 14, the guide member 16 and the sleeve 18, it is reciprocally slidable between the lower first position thereof illustrated in FIGS. 1, 4, 6 and 9 and the upper second position illustrated in FIGS. 2, 5 and 7. In this regard, when the slide member 20 is in the lower first position thereof, the upper end of the transfer pin 14 is positioned adjacent the upper end of the transfer passage 46, and an intermediate portion of the transfer pin 14 obstructs the lower end of the intermediate passage 48. The upper extremities of the leaves 32 extend upwardly into the storage chamber 42, but the rounded inner end of the trackway defined by the beveled edges 34 of the leaves 32 terminates adjacent the upper end of the intermediate passage 48. When the slide member 20 is then moved to the upper position thereof, the trackway defined by the edges 34 of the guide member 16 is positioned adjacent the bottom end of the storage chamber 42 so that capsules 24 in the storage chamber 42 naturally gravitate into the trackway. Further, when the slide member 20 is in the upper or second position thereof, the upper end of the transfer pin 14 is positioned beneath the adjacent lower end of the intermediate passage 48 so that the passage 48 is no longer obstructed and capsules 24 can pass from the intermediate passage 48 into the transfer passage 46.

Figure 8:
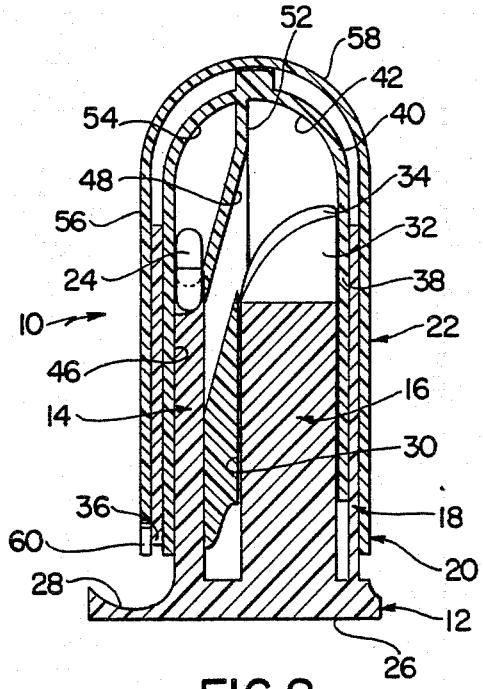

For use and operation of the dispenser 10, the storage chamber 42 is initially filled with a predetermined quantity of the capsules 24 by a manufacturer, distributor or vendor, and the cap portion 22 and the sleeve portion 20 are permanently assembled with the base portion 12, the transfer pin 14 and the guide member 16. Thereafter the capsules 24 can be individually dispensed from the dispenser 10 by reciprocating the cap member 22 and the slide member 20 between the lower first position thereof and the upper second position thereof, as illustrated in FIGS. 4 through 9. In this regard, when the slide member 20 is initially moved to the second position thereof, the funnel-like configuration of the bottom end of the chamber 42 causes a capsule 24 to gravitate into the trackway defined by the leaves 32 of the guide member 16. As illustrated in FIG. 6, when the slide member 20 is then returned to the lower first position thereof, the capsule 24 gravitates into the intermediate passage 48 where the transfer pin 14 prevents it from passing into the transfer passage 46. As illustrated in FIG. 7, when the slide member 20 is again moved upwardly to the second position thereof, the transfer pin 14 no longer obstructs the lower end of the intermediate passage 48 so that the capsule 24 falls into the transfer passage 46 where it rests on the upper end of the transfer pin 14. As illustrated in FIGS. 8 and 9, when the slide member 20 is thereafter moved downwardly to the first position thereof, the transfer pin 14 supports the capsule 24 so that it is moved upwardly in the transfer passage 46 and falls into one of the adjacent outlet passages 44 and from there into the recess 28. Further, it will be appreciated that although the slide member 20 must be reciprocated upwardly and downwardly twice in order to dispense the first capsule 24 from the dispenser 10, thereafter an additional capsule 24 is dispensed each time the slide member is reciprocated upwardly and then downwardly once until the entire supply of capsules 24 in the dispenser 10 has been exhausted.

It is seen, therefore, that the instant invention provides an effective dispenser for dispensing small ingestible articles, such as pills, capsules or candies. The dispenser 10 is highly reliable for dispensing individual articles in succession. Further, the dispenser 10 is operable in a simple and easy manner by reciprocally moving the slide member 20 and the cap member 22 upwardly and then downwardly with respect to the base portion 12. Accordingly, it is seen that the dispenser of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispenser for dispensing articles of substantially uniform dimension and configuration comprising a base receivable on a supporting surface, a slide member mounted on said base so that it is slidable with respect thereto between a lower first position and an upper second position when said base is received on said supporting surface, said slide member having a storage chamber therein for containing a plurality of said articles, an intermediate passage dimensioned and configured for receiving and containing a single one of said articles and communicating with said storage chamber for individually receiving articles therefrom, a transfer passage communicating with said intermediate passage, said transfer passage having upper and lower ends, and an outlet passage communicating with said transfer passage adjacent said transfer passage upper end, said outlet passage having a lower end and an outlet opening therein adjacent the lower end thereof, guide means mounted on said base and operable for guiding a single one of said articles from said storage chamber into said intermediate passage each time said slide member is moved from said first position thereof to said second position thereof and back to said first position thereof, and transfer means traveling in said transfer passage and operative for obstructing the passage of said articles from said intermediate passage to said transfer passage when said slide member is in the first position thereof and operative for allowing a single one of said articles to gravitate from said intermediate passage to said transfer passage and for then moving said article upwardly into said outlet passage when said slide member is moved from said first position thereof to said second position thereof and back to said first position thereof.

2. In the dispenser of claim 1, said guide means further characterized as defining a rounded downwardly extending trackway terminating adjacent said intermediate passage when said slide member is in said first position thereof.

3. In the dispenser of claim 2, said storage chmaber being dimensioned and configured for guiding one of said articles into said trackway when said slide member is in said second position thereof.

4. In the dispenser of claim 1, said articles further characterized as capsule-like articles.

5. In the dispenser of claim 1, said guide means being operable for guiding a single one of said articles from said storage chamber into said intermediate passage each time said slide member is moved from said first position thereof to said second position thereof and back to said first position thereof.

6. A dispenser for dispensing articles of substantially uniform dimension and configuration comprising a base receivable on a supporting surface, a slide member mounted on said base so that it is slidable with respect thereto between a lower first position and an upper second position when said base is received on said supporting surface, said slide member having a storage chamber therein for containing a plurality of said articles, an intermediate passage dimensioned and configured for receiving and containing a prespecified quantity of said articles and communicating with said storage chamber for receiving articles therefrom in said prespecified quantity, a transfer passage communicating with said intermediate passage, said transfer passage having upper and lower ends, and an outlet passage communicating with said transfer passage adjacent said transfer passage upper end, said outlet passage having a lower end and an outlet opening therein adjacent the lower end thereof, guide means mounted on said base and operable for guiding said prespecified quantity of said articles from said storage chamber into said intermediate passage each time said slide member is moved from said first position thereof to said second position thereof and back to said first position thereof, and transfer means traveling in said transfer passage operative for obstructing the passage of said articles from said intermediate passage to said transfer passage when said slide member is in the first position thereof and operative for allowing said prespecified quantity of said articles to gravitate from said intermediate passage to said transfer passage and for then moving said prespecified number of articles upwardly into said outlet passage when said slide member is moved from said first position thereof to said second position thereof and back to said first position thereof.

7. A dispenser for dispensing articles of substantially uniform dimension and configuration comprising a base receivable on a supporting surface, a slide member mounted on said base so that it is slidable with respect thereto between a lower first position and an upper second position when said base is received on said supporting surface, said slide member having a storage chamber therein for containing a plurality of said articles, an intermediate passage communicating with said storage chamber for receiving articles therefrom and an outlet passage having a lower end and an outlet opening therein adjacent the lower end thereof, guide means mounted on said base and operable for guiding said articles from said storage chamber into said intermediate passage when said slide member is moved from said first position thereof to said second position thereof and back to said first position thereof, transfer means operative for obstructing the passage of said articles from said intermediate passage to said outlet passage when said slide member is in the first position thereof and operative for transferring a single one of said articles from said intermediate passage to said outlet passage when said slide member is moved from said first position thereof to said second position thereof and back to said first position thereof, a tubular sleeve extending upwardly from said base, said slide member traveling in said sleeve between said first and second positions of said slide member, said sleeve having an outlet opening therein which is aligned with said outlet opening in said slide member when said slide member is in said first position thereof, and a tubular cap member on said slide member, said cap member including a tubular outer shell and traveling with said slide member, said cap member enclosing said sleeve when said slide member is in said second position thereof.

8. A dispenser for dispensing articles of substantially uniform dimension and configuration comprising a base receivable on a supporting surface, a slide member mounted on said base so that it is slidable with respect thereto between a lower first position and an upper second position when said base is received on said supporting surface, said slide member having a storage chamber therein for containing a plurality of said articles, an intermediate passage communicating with said storage chamber for receiving articles therefrom, a transfer passage and an outlet passage, said intermediate passage extending angularly downwardly from said storage chamber to said transfer passage, said outlet passage having a lower end and an outlet opening therein adjacent the lower end thereof, guide means mounted on said base and operable for guiding a single one of said articles from said storage chamber into said intermediate passage when said slide member is moved from said first position thereof to said second position thereof and back to said first position thereof, and a transfer pin traveling in said transfer passage and obstructing the adjacent end of said intermediate passage when said slide member is in said first position thereof but not when said slide member is in said second position thereof, said transfer passage being dimensioned and oriented for receiving a single one of said articles from said intermediate passage when said slide member is in said second position thereof, said transfer pin being operative for engaging an article received in said transfer passage and for transferring it to said outlet passage as said slide member is moved from said second position thereof to said first position thereof.

9. In the dispenser of claim 8, said transfer pin being mounted on said base.

10. In the dispenser of claim 9, said slide member being reciprocally movable in a substantially vertical direction when said base is received on a supporting surface, said transfer pin extending substantially perpendicularly upwardly from said base.

11. In the dispenser of claim 10, said articles further characterized as capsule-like articles.

* * * * *